US005410213A

United States Patent [19]

Harchenko et al.

[11] Patent Number: 5,410,213

[45] Date of Patent: Apr. 25, 1995

[54] MOUNTING STRAP FOR REPLACEMENT HALOGEN LAMP

[75] Inventors: David J. Harchenko, Sparta; James B. Anderson, Cookeville; Billy R. Maynard, Sparta, all of Tenn.

[73] Assignee: Cooper Industries, Wagner Lighting Division, Sparate, Tenn.

[21] Appl. No.: 14,223

[22] Filed: Feb. 5, 1993

[51] Int. Cl.[6] ..... H01J 5/48

[52] U.S. Cl. ..... 313/318.1; 313/634; 362/226

[58] Field of Search ..... 313/318, 578, 579, 634; 362/226; 445/22, 23

[56] References Cited

U.S. PATENT DOCUMENTS 3,510,718 5/1970 Vetere ..... 313/318

4,879,491 11/1989 Hirozumi et al. ..... 313/318

*Primary Examiner*—Donald J. Yusko

*Assistant Examiner*—N. D. Patel

*Attorney, Agent, or Firm*—Burns, Doane, Swecker & Mathis

[57] ABSTRACT

A mounting assembly for mounting a replaceable light bulb in a headlight assembly. The mounting assembly has a pair of mounting straps. Each mounting strap has a stem and a U-shaped channel. The U-shaped channel has three sides wherein the first and second sides are basically parallel to each other and perpendicular to the third side. The first and second sides each have a flange attached to the end opposite the third side. In addition, the first and/or second sides have an elongated slot for a portion of their length for receiving a section of a light bulb when the light bulb is mounted in the mounting straps. The light bulb is secured within the mounting straps by connecting the flanges of one strap to the flanges of the other strap by welding or rivets.

33 Claims, 6 Drawing Sheets

MOUNTING STRAP FOR REPLACEMENT HALOGEN LAMP

FIELD OF THE INVENTION

The present invention relates to a method and apparatus for securing a light bulb in a fixture, and more particularly to a method and apparatus for mounting a replacement bulb in a headlight assembly.

BACKGROUND OF THE INVENTION

In the car industry when a headlight burns out or does not function properly, the whole headlight assembly may need to be replaced. However, in some headlight assemblies only the light bulb is replaced. When the light bulb is replaced however, it is critical that the bulb is situated within the headlight assembly to very exacting standards so that the light coming out of the headlight is angled in the proper direction.

FIGS. 1 and 2 illustrate a known replacement lamp assembly. FIGS. 1*a*–1*d* illustrate a mounting strap 10 used in the mounting assembly. The mounting strap 10 has a stem 18 and a U-shaped channel formed at one end of stem 18. The U-shaped channel has three sides 16, 20 and 22, respectively. The first and second sides 20 and 22 are substantially parallel to each other and substantially perpendicular to the third side 16. The first and second sides 20 and 22 each have a flange 12 attached at an end opposite to the end connected to the side 16. The flange 12 is bent at an angle so that the angle formed between the outside of the second side 22 and the flange 12 is slightly less than perpendicular. As illustrated in FIG. 1*b*, the first and second sides 20 and 22 each have two projections 14 on their inner surfaces so that the projections extend into the U-shaped channel. The corners of the projection 14 are relatively sharp.

FIG. 2 illustrates a known replacement light bulb. The light bulb 30 has a bulb section 32 which contains a filament 34 and electrical contacts 37. The light bulb 30 also has a base section 36 through which the electrical connectors 37 exit the light bulb. The base section 36 has a flat pressed glass surface. Each of the main sides of the base section contains four depressions 38 for receiving the projections 14 on the mounting strap 10.

The replaceable light bulb 30 is secured between two mounting straps 10. First, the base section 36 of the light bulb 30 is positioned inside the U-shaped channel of the first mounting strap. The second mounting strap is then positioned opposite to the first mounting strap so that the base section 36 of the light bulb is inside the U-shaped channel of the second mounting strap. The base section 36 of the light bulb has a length that is sufficient to keep the two mounting straps from touching each other when they are positioned around the base section 36. The flanges 12 of the opposing mounting straps are then forced together and connected by rivets, or the like, to secure the pressed glass base of the light bulb between the mounting straps. When the flanges are forced together, the first and second sides 20 and 22 of the U-shaped channel are urged toward each other. Therefore, the mounting straps 10 must be aligned so that the projections 14 move into the depressions 38 when the two mounting straps are connected. Once the light bulb has been secured in the mounting straps 10, the stems of the mounting straps are inserted into a hot plastic holder which, when cooled, is used to secure the light bulb assembly in a head light.

One problem with the prior art assembly is the possibility of breaking the glass base of the light bulb during the mounting process. The sharp edges of projections 14 on the mounting strap slope away quickly from the top of the projections. As a result, if the projections 14 of the mounting straps are not perfectly aligned with depressions 38 in the glass base of the light bulb, the edges of the projections may break the glass base when the light bulb is mounted in the mounting straps. This problem is further exasperated by the fact that it is hard to properly align the depressions in the pressed glass base section with the projections on the mounting straps since there is no means for guiding the projections and depressions into proper alignment.

Furthermore, in the prior art assembly, the entire length of the first and second sides of the U-shaped body are contact surfaces for securing the light bulb. Therefore, the corners of the U-shaped body exert pressure on the corners of the pressed glass base 36. As a result, if the pressed glass base is not properly aligned, the corners of the pressed glass base may be pinched and possibly broken when the sides of the U-shaped body are moved together during the mounting operation.

SUMMARY OF THE DISCLOSURE

The present invention relates to a mounting assembly for a replaceable light bulb. The mounting assembly has a pair of mounting straps. Each mounting strap has a stem for mounting the strap in a holder. A U-shaped body is located at one end of the stem for securing the bulb. The U-shaped body has three sides, the first and second sides are facing each other and at one end are connected to the third side which is perpendicular to the first and second sides. The first and/or second sides of the U-shaped body also have an elongated slot for a portion of their length which is perpendicular to the stem for receiving a portion of the light bulb. In addition, the mounting strap has first and second flanges which are connected to the other end of said first and second sides of said U-shaped body. The flanges are bent at an angle so that the angle formed between the outside of the U-shaped body and each flange is less than perpendicular.

BRIEF DESCRIPTION OF THE DRAWINGS

The present invention will now be described in more detail with reference to preferred embodiments of the invention, given only by way of example, and illustrated in the accompanying drawings, in'which:

FIGS. 1*a*–1*d* illustrate several views of a prior art mounting strap;

DETAILED DESCRIPTION OF PREFERRED EMBODIMENTS

Figures 1A, 1C, 1D:
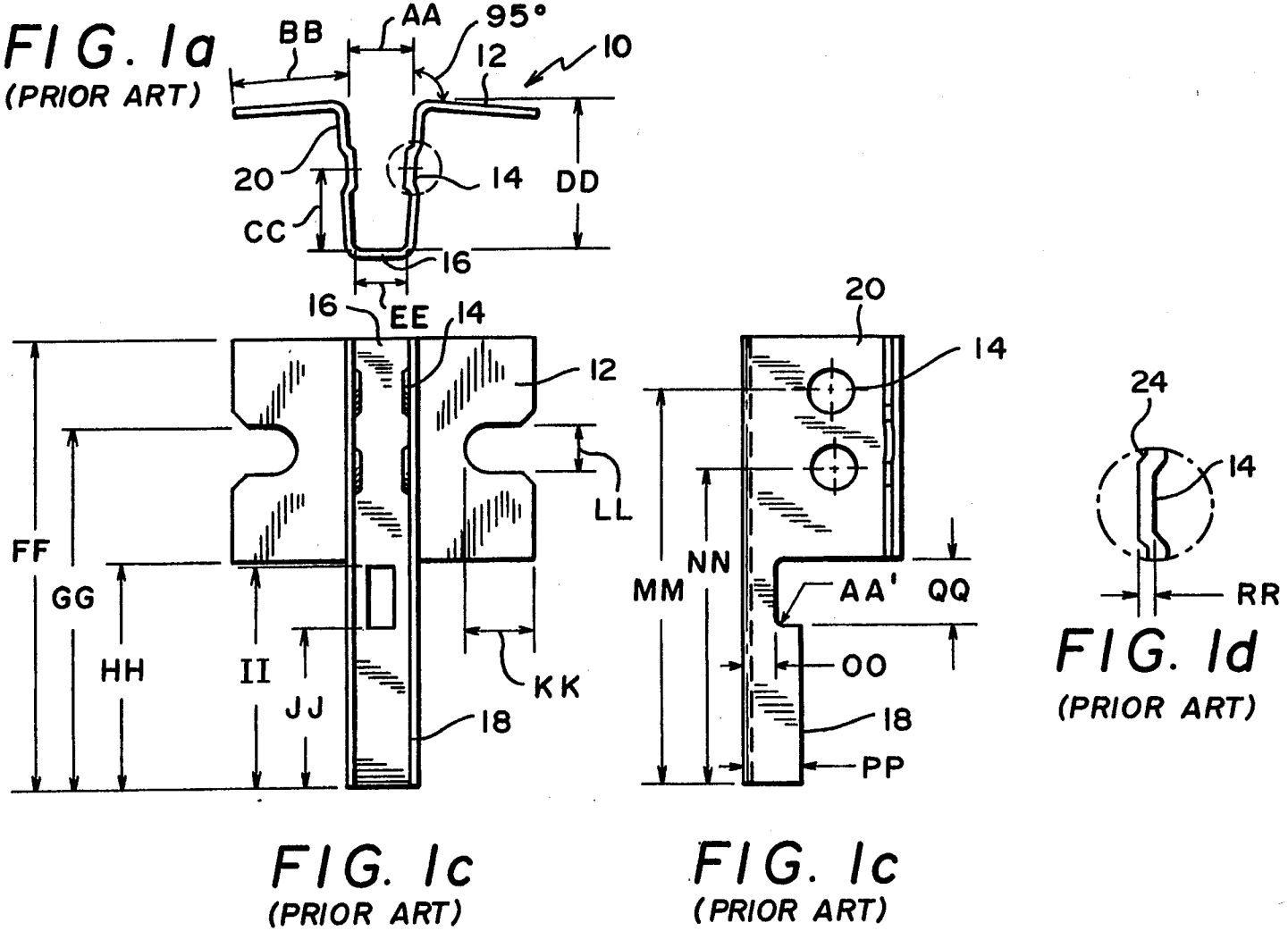
FIG. 1a (PRIOR ART)
FIG. 1c (PRIOR ART)
FIG. 1c (PRIOR ART)
FIG. 1d (PRIOR ART)
Figure 2A:
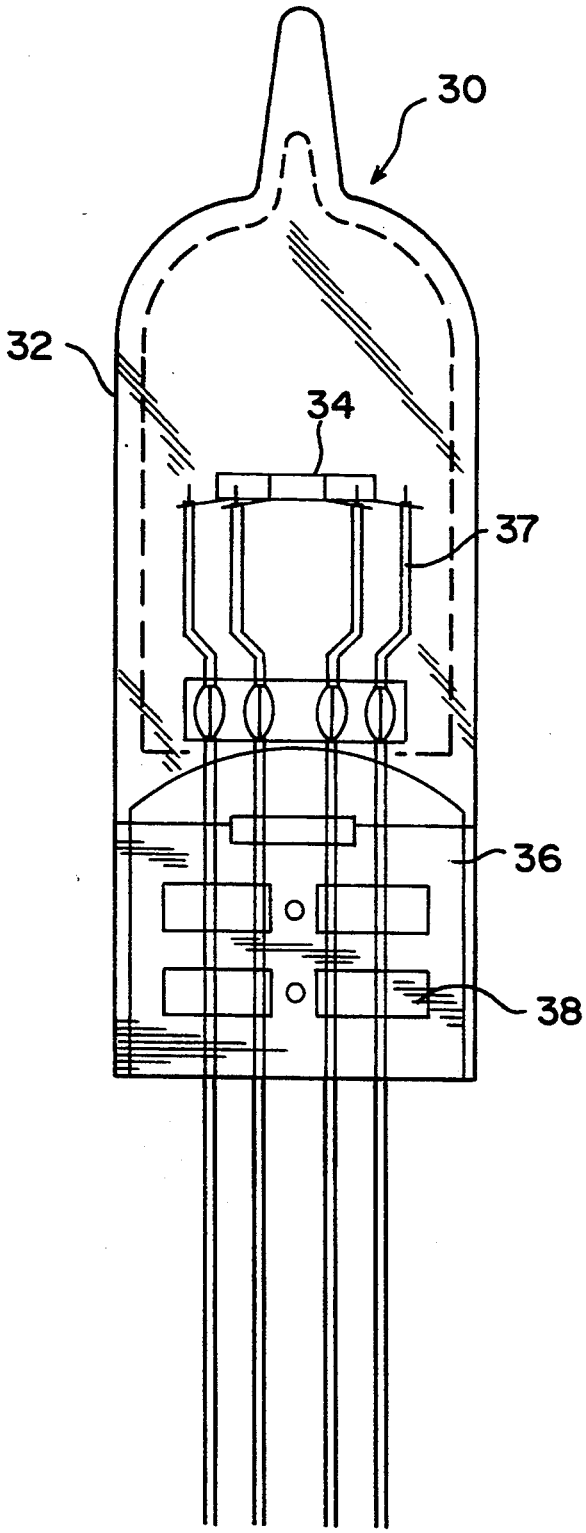
FIG. 2a (PRIOR ART)
FIGS. 2*a*–2*b* illustrate several views of a prior art replaceable light bulb.
Figure 2B:
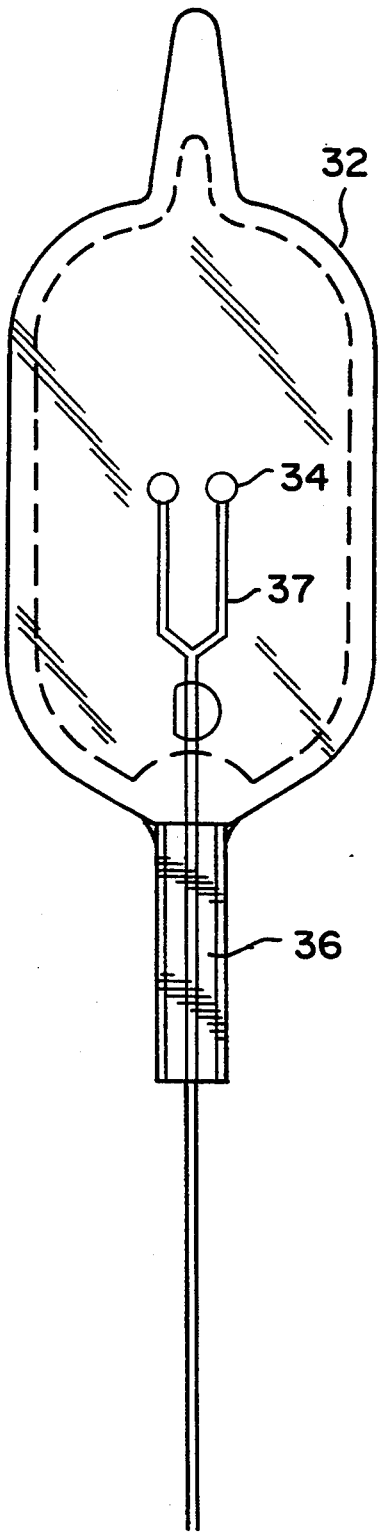
FIG. 2b (PRIOR ART)
Figures 3A, 3B, 3C:
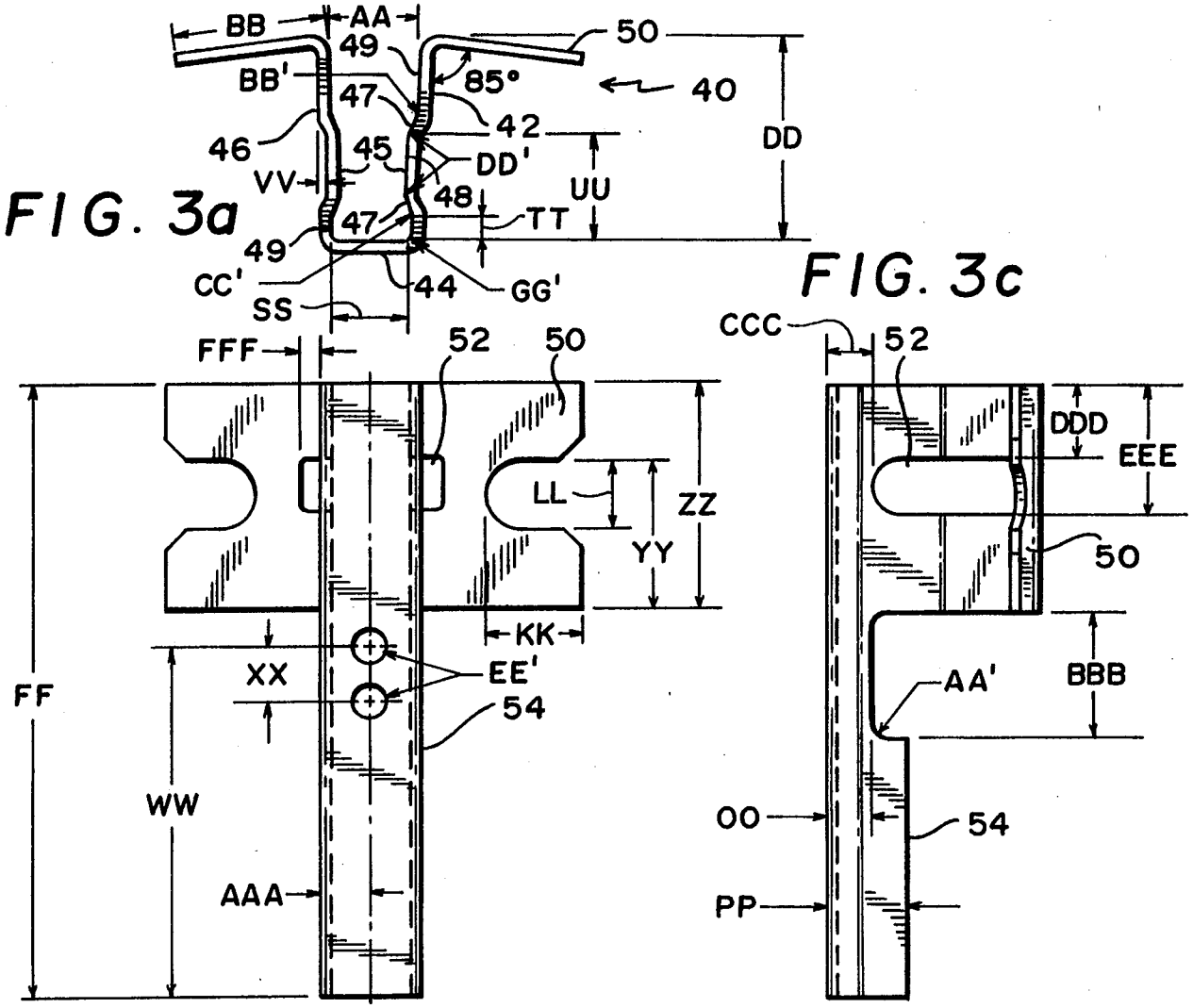
FIGS. 3*a*–3*c* illustrate several views of a mounting strap of one embodiment of the present invention.
Figure 6A:
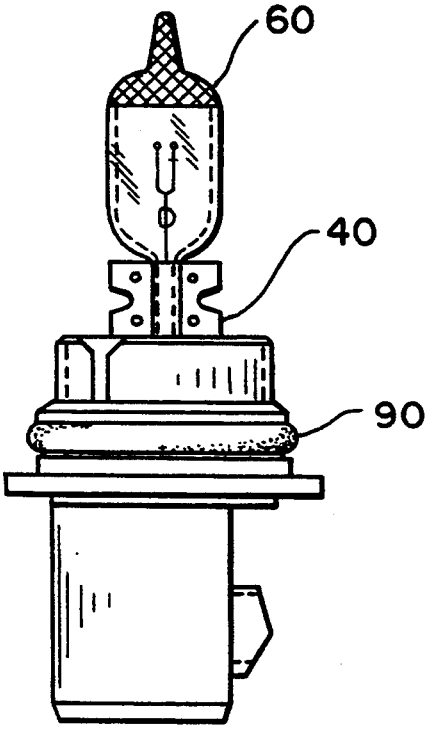
FIGS. 6*a*–6*b* illustrate several views of a mounting assembly of the present invention.
Figure 6B:
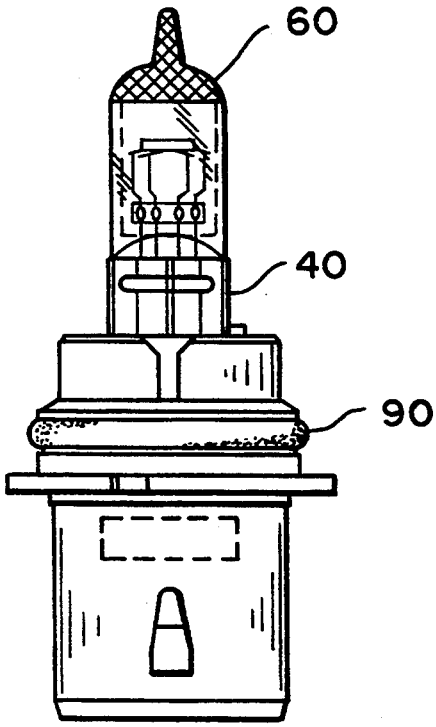

FIGS. 3*a*–3*c* illustrate several views of a mounting strap used in the present invention. The mounting strap 40 has a stem 54 which can be inserted into a holder 90 to secure the mounting straps 40 and a light bulb 60 secured therein within the headlight assembly as illustrated in FIGS. 6*a*–6*b*. At one end of the stem 54, the mounting strap 40 forms a U-shaped body with three sides 42, 44, and 46, respectively. The first and second sides 42 and 46 are substantially parallel to each other and are connected to the third side 44. In one embodiment of the present invention, the first and second sides are substantially perpendicular to the third side 44. However in other embodiments of the present invention, the first and second sides are angled away from the inside of the U-shaped body.

A flange 50 is connected to each of the first and second sides 42 and 46. The flanges 50 extend outwardly away from the first and second sides 42 and 46 so that the angle formed between the flanges and the outside of the first or second sides is less than perpendicular. In one embodiment of the present invention, the angle formed between the flanges 50 and the first and second sides 42 and 46 is approximately 85°.

At least one of the first and second sides 42 and 46 of the U-shaped body has an elongated slot 52 for engaging with a projection 64 on the pressed glass base of the replaceable light bulb 60. In the present invention as illustrated in FIGS. 3*a*–3*c*, each of the first and second sides 42 and 46 of the U-shaped body has an elongated slot 52. The elongated slot 52 can start at one end of the first and second sides 42 and 46 where the first and second side meet flanges 50 and runs for a portion of the length of the first and second sides. The elongated slot 52 preferably has one open end. In addition, the elongated slot 52 is perpendicular to the stem 54.

The first and second sides also have a ridge or a raised section 45 for securing the light bulb therebetween. The first and second sides 42 and 46 also have transition sections 47 and noncontact sections 49 in addition to the raised sections 45. The sides of the raised section gently slope away from the raised section 45 and form the transition sections. The transition sections slope away from the raised sections to the noncontact sections which do not contact the base of the light bulb when the light bulb is secured in the mounting straps. In the present embodiment, the raised sections are located near the middle of the first and second sides 42 and 46. At the edge of the raised sections, the transition sections slope away from the raised sections to the noncontact sections. As a result, the corners of the U-shaped body are noncontact surfaces.

Figure 4A:
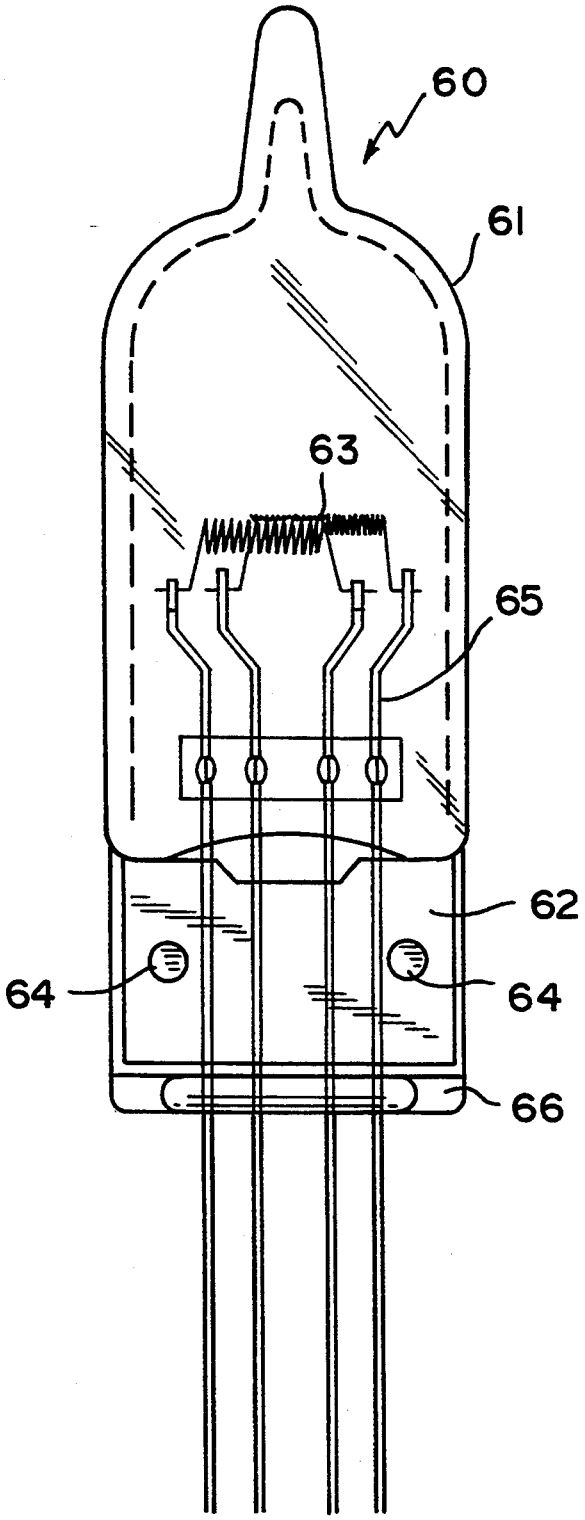
FIG. 4a (PRIOR ART)
FIGS. 4*a*–4*b* illustrate several views of a prior art replaceable light bulb for use with the present invention.
Figure 4B:
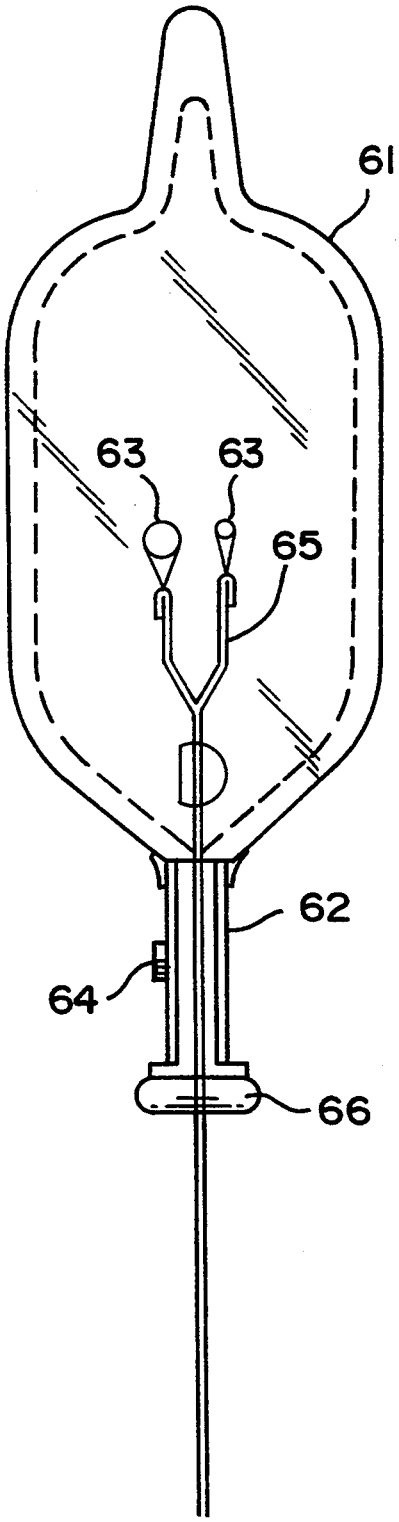
FIG. 4b (PRIOR ART)

FIGS. 4*a* and 4*b* illustrate a replaceable light bulb 60 for use with the present invention. The light bulb 60 has a bulb section 61 which contains filaments 63 and electrical connectors 65. The light bulb 60 also has a rectangular pressed glass base section 62 through which the electrical connectors 65 exit the light bulb. The base section has a flat pressed glass surface. On one side of the pressed glass base section 62, there is at least one projection 64. The pressed glass base 62 has two projections 64. The projections 64 can be on either side or on both sides of the pressed glass base 62. The projections 64 are inserted into one of the elongated slots 52 in the first and second sides of the U-shaped body when the light bulb is mounted in the mounting strap. One end of the glass base 62 has a lip 66 which protrudes out from the glass base 62 to help secure the light bulb in place when the light bulb is mounted in the mounting strap 40.

Although the bulb 60 is illustrated in FIGS. 4*a* and 4*b* is prior art, the present invention includes a new system of mounting the bulb. During the mounting operation, the replaceable light bulb 60 is secured between two mounting straps 40. First, one of the projections 64 on the pressed glass base 62 is inserted into the elongated slot 52 in the first or second side 42 or 46 of the first mounting strap. The second projection 64 on the pressed glass base 62 is then inserted into the elongated slot 52 in the first or second side 42 or 46 of the second mounting strap. The projections 64 help to retain the light bulb 60 in the proper mounting position during the mounting operation. As a result, the pressed glass base 62 of the light bulb 60 is properly positioned inside the U-shaped channels of the first and second mounting straps. The pressed glass base has a length that is sufficient to keep the two mounting straps from touching each other when they are positioned around the pressed glass base.

The flanges 50 of the first mounting strap are then forced toward the opposing flanges of the second mounting strap so that the angle formed between the each flange 50 and the outside of the U-shaped bodies of the mounting straps is greater than perpendicular. In one embodiment of the present invention, the angle between the flanges 50 and the outside of the U-shaped bodies of the mounting straps is approximately 95° after the flanges have been forced together. After, the flanges 50 are forced together, the flanges are connected together by welding, rivets, or the like.

When the flanges 50 are forced together, the first and second sides 42 and 46 of each mounting strap are urged toward each other. As a result, the raised sections 45 of each mounting strap are urged into contact with the pressed glass base 62 of the light bulb 60 to secure the light bulb 60 in the mounting straps. In addition, the third side 44 of the U-shaped body of each mounting strap contacts the side of the pressed glass base 62 to further secure the light bulb 60 in the mounting straps. Therefore, only the raised sections 45 and the third side 44 contact the pressed glass base 62. Since the raised sections 45 and the third side 44 have smooth surfaces and do not have sharp edges, the present invention minimizes the amount of breakage that occurs during the mounting operation. Furthermore, since the corners of the U-shaped body are noncontact surfaces, the corners do not exert a force upon the glass base 62 which minimizes the chances of the corners of the glass base from being pinched and broken during the mounting operation.

Figures 5A, 5B, 5C:
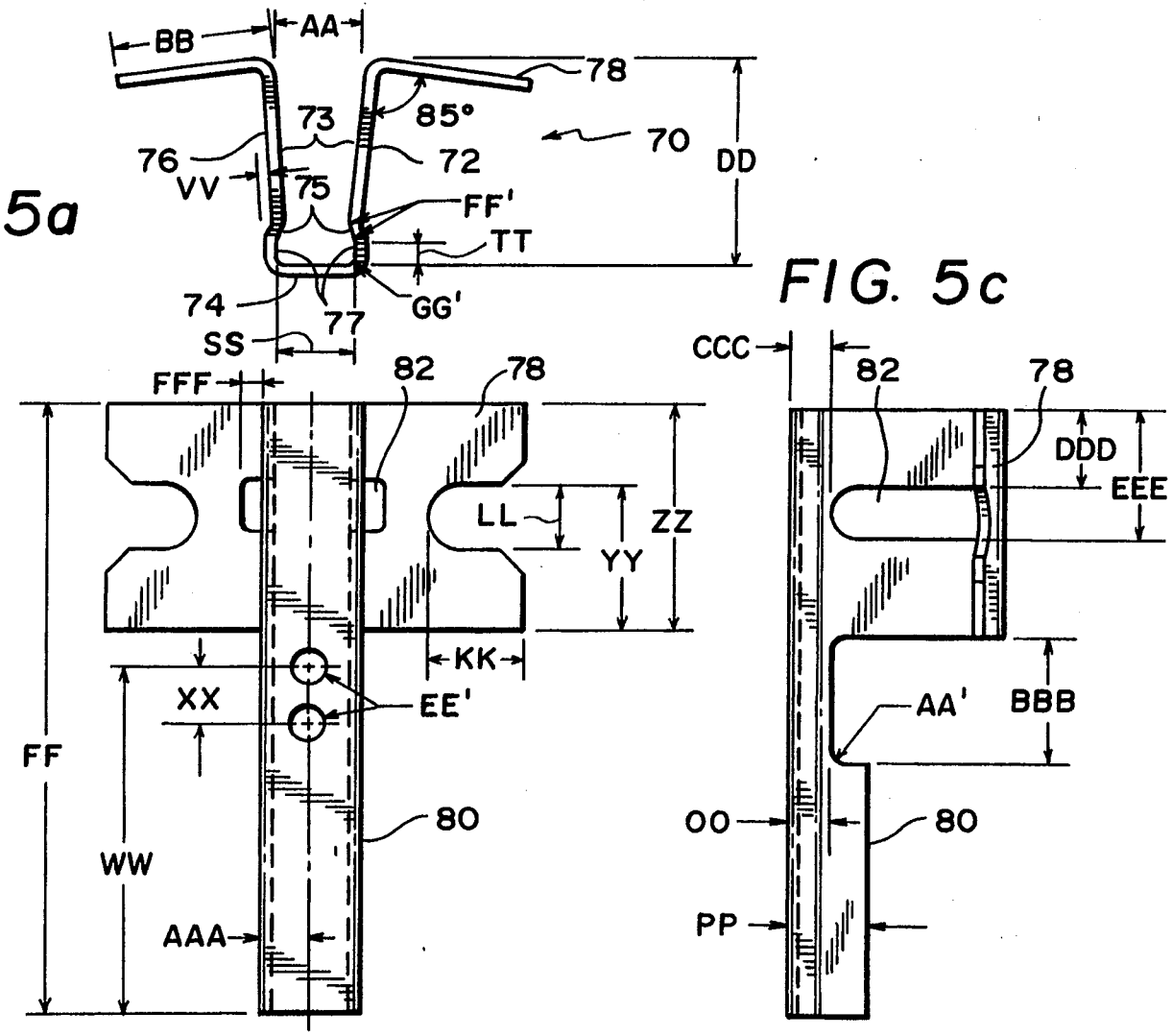
FIGS. 5*a*–5*c* illustrate several views of a mounting strap of another embodiment of the present invention.

FIGS. 5*a*–5*c* illustrate several views of another embodiment of the present invention. A mounting strap 70 has a stem 80 which can be inserted into a holder to secure the mounting strap and a light bulb secured therein within the headlight assembly. At one end of the stem 80, the mounting strap 70 forms a U-shaped body with three sides 72, 74, and 76, respectively. The first and second sides 72 and 76 are substantially parallel to each other and at one end are connected to the third side 74. In one embodiment of the present invention, the first and second sides are substantially perpendicular to the third side 74. However in other embodiments of the present invention, the first and second sides are tapered toward the third side.

A flange 78 is connected to each of the first and second sides 72 and 76. The flanges 78 extent outwardly from the first and second sides 72 and 76 so that the angle formed between the flanges and the outside of the first or second sides is less than perpendicular. In one embodiment of the present invention, the angle between the flanges 78 and the first and second sides 72 and 76 is approximately 85°.

At least one of the first and second sides 72 and 76 of the U-shaped body has an elongated slot 82 engaging with a projection 64 on the pressed glass base of the replaceable light bulb 60. In the present embodiment as illustrated in FIGS. 5*a*–5*c*, both of the first and second sides 72 and 76 of the U-shaped body have an elongated slot 82. The elongated slot 82 can start at one end of the first and second sides 72 and 76 where the first and second side meet the flange 78 and runs for a portion of the length of the first and second sides. The elongated slot 82 can also have one open end. In addition, the elongated slot 82 is perpendicular to the stem 80.

The first and second sides 72 and 76 also have a contact surface 73 for contacting the pressed glass base 62 of the light bulb when the bulb is secured in the mounting straps. In addition, the first and second sides also have a noncontact surface 77 which is located near the corners of the U-shaped body. The contact surface 73 and the noncontact surface 77 are connected by a transition region 75 which slopes away from the contact surface 73 to the noncontact surface 77.

During the mounting operation, the replaceable light bulb 60 is secured between two mounting straps 70. First, one of the projections 64 on the pressed glass base 62 is inserted into the elongated slot 82 in the first or second side 72 and 76 of the first mounting strap. The second projection 64 on the pressed glass base 62 is then inserted into the elongated slot 82 in the first or second side 72 and 76 of the second mounting strap. The projections 64 help to retain the light bulb 60 in the proper mounting position during the mounting operation. As a result, the pressed glass base 62 of the light bulb 60 is properly positioned inside the U-shaped channels of the first and second mounting straps. The pressed glass base has a length that is sufficient to keep the two mounting straps from touching each other when they are positioned around the pressed glass base.

The flanges 78 of the first mounting strap are then forced toward the opposing flanges of the second mounting strap so that the angle formed between the each flange 78 and the outside of the U-shaped bodies of the mounting straps is greater than perpendicular. In one embodiment of the present invention, the angle between the flanges 78 and the outside of the U-shaped bodies of the mounting straps is approximately 95° after the flanges are forced together. After, the flanges 78 are forced together, the flanges are connected together by welding, rivets, or the like.

When the flanges 78 are forced together, the first and second sides 72 and 76 of each mounting strap are urged toward each other. As a result, the contact surfaces 73 of the first and second sides 72 and 76 are urged into contact with the pressed glass base 62 of the light bulb 60 to secure the light bulb 60 in the mounting straps. In addition, the third side 74 of the U-shaped body of each mounting strap contacts the side of the pressed glass base to further secure the light bulb in the mounting straps. Since the contact surfaces 73 of the first and second sides 72 and 76 have smooth surfaces and do not have sharp edges, the present invention minimizes the amount of breakage that occurs during the mounting operation. Furthermore, since the corners of the U-shaped body are noncontact surfaces 77, the corners do not exert a force on the corners of the glass base which minimizes the chances of the glass base from being pinched and possibly broken during the mounting operation.

The following table illustrates the various dimensions used in a preferred embodiment of the mounting strap of the present invention. One of ordinary skill in the art will understand that the following dimensions define several embodiments of the present invention but does not limit the present invention thereto. The following dimensions are all in inches.

TABLE 1

| | | | | | |
|---|---|---|---|---|---|
| AA | 0.130 | LL | 0.090 | WW | 0.460 |
| BB | 0.221 | MM | 0.712 | XX | 0.075 |
| CC | 0.150 | NN | 0.574 | YY | 0.195 |
| DD | 0.275 | OO | 0.060 | ZZ | 0.300 |
| EE | 0.105 | PP | 0.110 | AAA | 0.069 |
| FF | 0.810 | QQ | 0.125 | BBB | 0.170 |
| GG | 0.655 | RR | 0.010 | CCC | 0.060 |
| HH | 0.410 | SS | 0.108 | DDD | 0.100 |
| II | 0.405 | TT | 0.030 | EEE | 0.170 |
| JJ | 0.285 | UU | 0.140 | FFF | 0.030 |
| KK | 0.125 | VV | 0.010 | | |

The following table illustrates the dimensions of the curved sections of the mounting straps of the present invention. One of ordinary skill in the art will understand that the following dimensions define several embodiments of the present invention, but does not limit the present invention thereto.

TABLE 2

| | | | |
|---|---|---|---|
| AA′ | 0.020 R | EE′ | 0.026 R |
| BB′ | 0.030 R | FF′ | 0.030 R |
| CC′ | 0.030 R | GG′ | 0.010 R |
| DD′ | 0.030 R | | |

While a particular embodiment of the present invention has been described and illustrated, it should be understood that the invention is not limited thereto since modifications may be made by persons skilled in the art. The present application contemplates any and all of modifications that fall within the sphere and scope of the underlying invention disclosed and claimed herein.

What is claimed is:

1. A mounting strap for a light bulb, comprising:

a stem;

a U-shaped body at one end of said stem for securing the bulb;

the U-shaped body has first, second, and third sides, wherein said first and second sides are arranged facing each other;

each of said first and second sides are connected to the third side, which is substantially perpendicular to the first and second sides;

said first side having an elongated slot extending perpendicular to said stem for receiving a section of said bulb, said elongated slot starting at an end of said first side that is opposite the third side; and a flange connected to each of said first and second sides of said U-shaped body.

2. The mounting strap for a light bulb according to claim 1, wherein each of said flanges forms an angle with respect to the side from which it extends that is less than perpendicular.

3. The mounting strap for a light bulb according to claim 1, wherein each of said first and second sides of said U-shaped body forms an angle with respect to said third side that is slightly greater than 90°.

4. The mounting strap for a light bulb according to claim 1, wherein each of said first and second sides includes a protrusion for contacting said bulb.

5. The mounting strap for a light bulb according to claim 1, wherein said elongated slot has an open end.

6. The mounting strap for a light bulb according to claim 1, wherein each of said first and second sides of said U-shaped body has an elongated slot for receiving a section of said bulb.

7. A device for mounting a light bulb, comprising:

a pair of mounting straps, each strap including:

a stem for mounting the strap in a holder;

a U-shaped body at one end of said stem for securing the bulb, wherein the U-shaped body has first and second sides facing each other and a third side which is connected to each of the first and second sides and is substantially perpendicular to the first and second sides;

said first side having an elongated slot perpendicular to said stem for receiving a section of said bulb, said elongated slot starting at an end of said first side that is opposite the third side; and a flange connected to each of said first and second sides of said U-shaped body.

8. The device for mounting a light bulb according to claim 7, wherein each of said flanges forms an angle with respect to the side from which it extends that is less than perpendicular.

9. The device for mounting a light bulb according to claim 7, wherein each of said first and second sides includes a protrusion for contacting said bulb.

10. The device for mounting a light bulb according to claim 7, wherein said second side has an elongated slot for receiving a section of said bulb.

11. The device for mounting a light bulb according to claim 7, wherein said elongated slot has an open end.

12. The device for mounting a light bulb according to claim 7, wherein each of said first and second sides of said U-shaped body forms an angle with respect to said third side that is slightly greater than 90° before mounting.

13. The device for mounting a light bulb according to claim 7, wherein said flanges of the first strap are fastened to the flanges of said second strap by welding.

14. The device for mounting a light bulb according to claim 13, wherein when said flanges are fastened together, each of said flanges forms an angle with respect to the side which it is attached that is greater than 90°.

15. A mounting strap for a light bulb, comprising:

a stem for mounting the strap in a holder;

a U-shaped body at one end of said stem for securing the bulb, wherein the U-shaped body has three sides, the first and second of said sides are facing each other and are connected to the third side, which is substantially perpendicular to the first and second sides;

said first side having an elongated slot perpendicular to said stem for receiving a section of said bulb;

each of said first and second sides have raised sections for contacting a base section of said bulb, noncontact sections and transition sections which interconnect said raised sections to said noncontact sections; and a flange connected to each of said first and second sides of said U-shaped body.

16. The mounting strap for a light bulb according to claim 15, wherein each of said flanges forms an angle with respect to the side from which it extends that is less than perpendicular.

17. The mounting strap for a light bulb according to claim 15, wherein each of said first and second sides of said U-shaped body forms an angle with respect to said third side that is slightly greater than 90°.

18. The mounting strap for a light bulb according to claim 15, wherein each of said raised sections are in middle portion of its respective side and has a noncontact section on each side thereof.

19. The mounting strap for a light bulb according to claim 15, wherein said elongated slot starts at an end of said first side that is opposite the third side.

20. The mounting strap for a light bulb according to claim 15, wherein said elongated slot has an open end.

21. The mounting strap for a light bulb according to claim 15, wherein each of said first and second sides of said U-shaped body has an elongated slot for receiving a section of said bulb.

22. A mounting strap for a light bulb, comprising:

a stem for mounting the strap in a holder;

a U-shaped body at one end of said stem for securing the bulb;

the U-shaped body has first, second, and third sides, said first and second sides facing each other and at one end are connected to the third side which is perpendicular to the first and second sides;

said first side having an elongated slot for receiving a section of said bulb;

said first and second sides each have at least one raised section for contacting said bulb, a transition section starting along one edge of each raised section and sloping away from said contact section and a noncontact section connected to said transition section;

a flange connected to each of said first and second sides of said U-shaped body.

23. The mounting strap for a light bulb according to claim 22, wherein said noncontact section is between the raised section and the third side on each of said first and second sides.

24. The mounting strap for a light bulb according to claim 23, wherein said raised section extends from the noncontact section to an end of said respective side.

25. A light bulb assembly, comprising:

a light bulb with a rectangular glass base, one end of said base connected to a bulb section and a first projection on a first surface of said glass base;

a pair of mounting straps, each strap including:

a stem for mounting the strap in a holder;

a U-shaped body at one end of said stem for securing the bulb, the U-shaped body has first, second, and third sides, said first and second sides facing each other and at one end are connected to the third side which is substantially perpendicular to the first and second sides;

said first side having an elongated slot for receiving said first projection on said glass base;

a flange connected to each of said first and second sides of said U-shaped body, wherein flanges of one of said straps are welded to flanges of another of said straps; and said elongated slot starting at an end of said first side that is connected to the flange.

26. A method of mounting a light bulb, comprising the steps of:

providing a light bulb with a glass base with a projection on a surface of said glass base;

providing a pair of mounting straps having U-shaped bodies, each strap including an elongated slot for receiving the projection of the glass base, and a pair of flanges connected to the U-shaped body, said elongated slot starting at an end of said U-shaped body which is connected to the flange;

sliding one of the mounting straps on each side of said glass base so that said projection is within the slot;

bending opposing flanges into contact with each other; and joining said opposing flanges together.

27. A device for mounting a light bulb, comprising:

a pair of mounting straps, each strap including:

a stem for mounting the strap in a holder;

a U-shaped body at one end of said stem for securing the bulb, wherein the U-shaped body has first and second sides facing each other and a third side which is connected to each of the first and second sides and is substantially perpendicular to the first and second sides;

said first side having an elongated slot for receiving a section of said bulb;

each of said first and second sides having raised sections for contacting a base section of said bulb, noncontact sections and transition sections which interconnect said raised sections to said noncontact sections; and a flange connected to each of said first and second sides of said U-shaped body.

28. The device for mounting a light bulb according to claim 27, wherein each of said flanges forms an angle with respect to the side from which it extends that is less than perpendicular.

29. The device for mounting a light bulb according to claim 27, wherein said second side has an elongated slot for receiving a section of said bulb.

30. The device for mounting a light bulb according to claim 27, wherein said elongated slot has an open end.

31. The device for mounting a light bulb according to claim 27, wherein each of said first and second sides of said U-shaped body forms an angle with respect to said third side that is slightly greater than 90° before mounting.

32. The device for mounting a light bulb according to claim 27, wherein said flanges of the first strap are fastened to the flanges of said second strap by welding.

33. The device for mounting a light bulb according to claim 32, wherein when said flanges are fastened together, each of said flanges forms an angle with respect to the side which it is attached that is greater than 90°.

* * * * *